United States Patent [19]

Bienek et al.

[11] Patent Number: 4,488,048

[45] Date of Patent: Dec. 11, 1984

[54] CONTAINER FOR THE STORAGE OF RADIOACTIVE MATERIAL

[75] Inventors: Heinz Bienek, Oberhausen; Wolfgang von Heesen, Gelsenkirchen; Wilhelm Wick, Essen, all of Fed. Rep. of Germany

[73] Assignee: Steag Kernenergie GmbH, Fed. Rep. of Germany

[21] Appl. No.: 331,295

[22] Filed: Dec. 16, 1981

[30] Foreign Application Priority Data

Dec. 22, 1980 [DE] Fed. Rep. of Germany ..... 3048380
Dec. 8, 1981 [DE] Fed. Rep. of Germany ..... 3148528

[51] Int. Cl.[3] ..... G21F 5/00
[52] U.S. Cl. ..... 250/506.1; 376/272
[58] Field of Search ..... 250/506.1, 507.1; 376/272

[56] References Cited

U.S. PATENT DOCUMENTS

| | | | |
|---|---|---|---|
| 3,754,140 | 8/1973 | Beierle | 250/507.1 |
| 3,770,964 | 11/1973 | Backus | 250/506.1 |
| 3,962,587 | 6/1976 | Dufrane et al. | 250/506.1 |
| 4,330,711 | 5/1982 | Ahner et al. | 250/506.1 |

*Primary Examiner*—Bruce C. Anderson
*Attorney, Agent, or Firm*—Andrus, Sceales, Starke & Sawall

[57] ABSTRACT

In a container for the storage of radioactive material comprising an inner casing for receiving the material and an outer casing made of a ceramic material which surrounds the inner casing, it is of prime importance that mechanical and thermal stresses which occur during storage and transport do not lead to destruction of the outer casing. In order to achieve this, the inner casing is held within the outer casing by contact distributed over a large surface area of the inner wall of the outer casing, the contact being achieved solely by frictional engagement, or by frictional engagement assisted by an adhesive. Preferably a contact element forming a frictional engagement element consists of a slotted sleeve and an abutment which is connected to the inner casing. Instead of a single contact element exhibiting a large contact area, a plurality of smaller contact elements can be used with an essentially uniform distribution of their individual contact areas over a large surface of the inner wall of the outer casing.

25 Claims, 33 Drawing Figures

Figure 1:
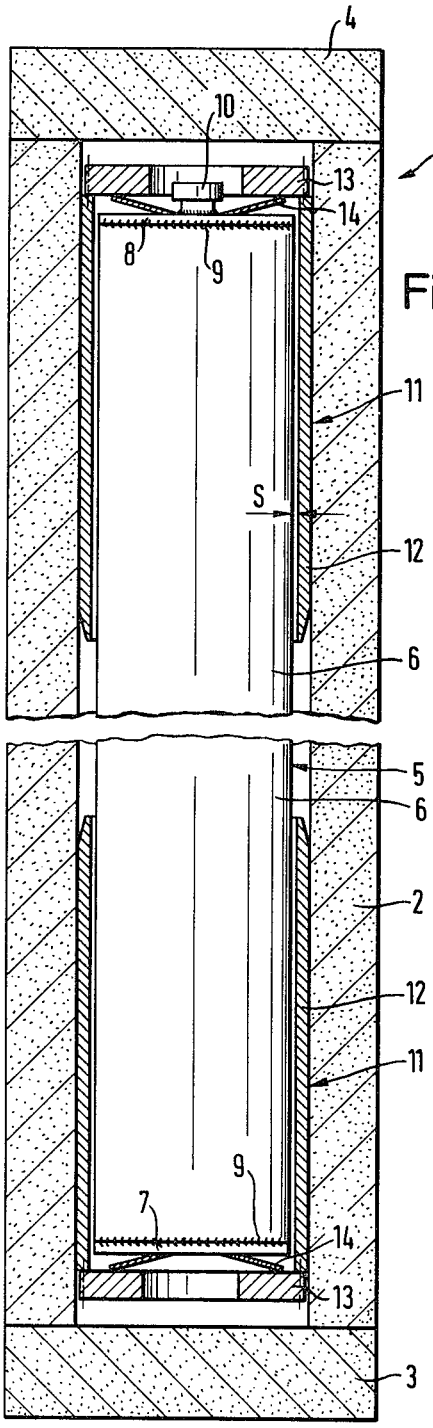

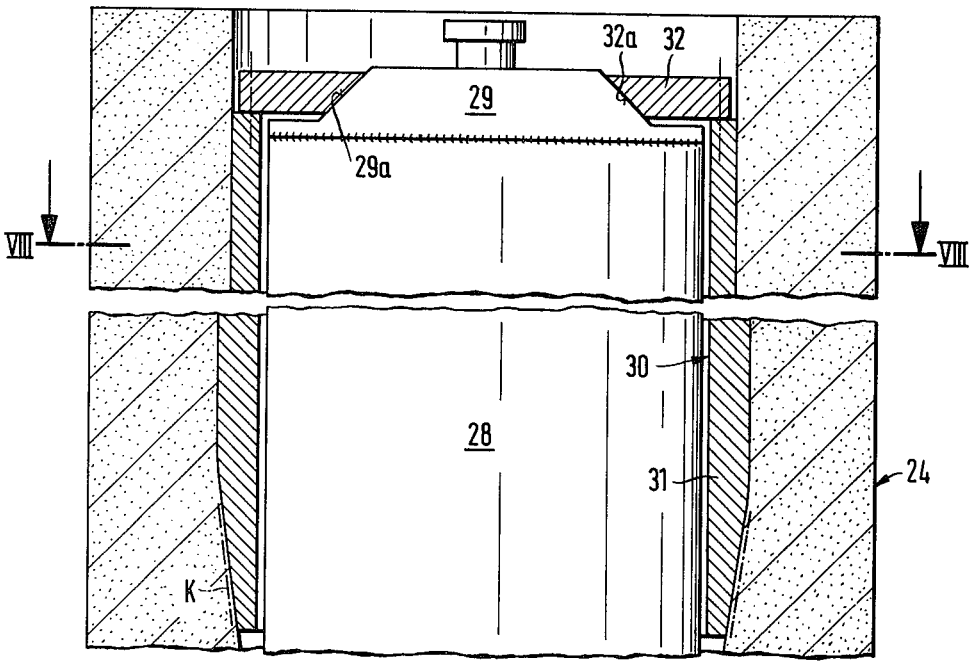
Fig. 7
Fig. 8
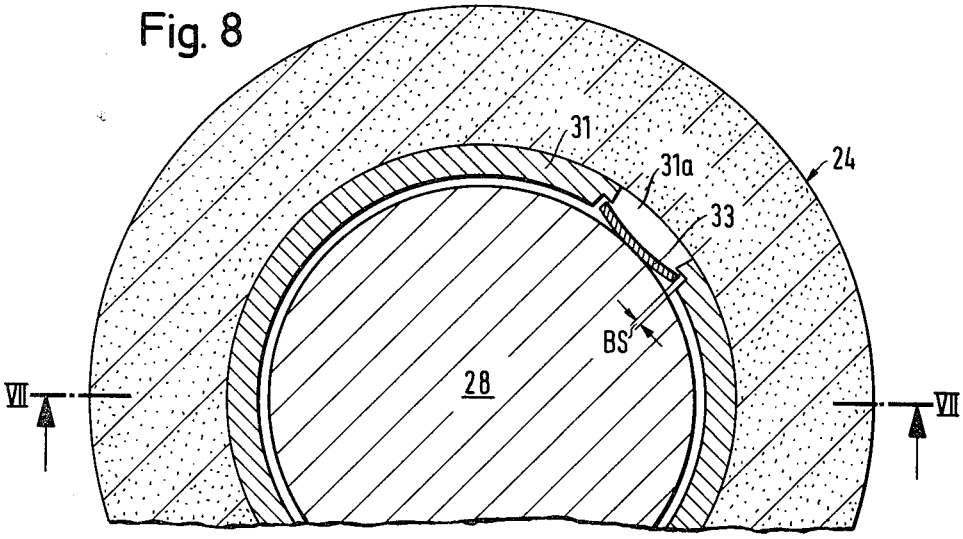

CONTAINER FOR THE STORAGE OF RADIOACTIVE MATERIAL

This invention relates to a container for the storage of radioactive material comprising an inner casing for receiving the material and an outer casing made of a ceramic material which surrounds the inner casing.

In use of known containers of this type thermal stress is caused in the inner casing and therefore also in the outer casing. Since the materials used for the outer casing and inner casing usually differ in their coefficient of thermal expansion, there exists the danger with known containers that the radial and axial thermal stresses occurring will reach values which will lead to the outer casing being damaged or destroyed.

Furthermore, in use of such a container, there is a danger that acceleration forces will be applied to the container. The outer casing has at least one insertion opening which is closed by a cover after the inner casing has been inserted. With the known containers there is a danger that, in a specified use of the container, intermittent stresses will be applied through the inner casing to the base or the cover, which will result in stress peaks causing brittle fracture of the ceramic outer casing. Even if the material is not destroyed by the intermittent acceleration forces, the connection between locking sections of the outer casing and the basic body of the outer casing may be broken.

It is an object of the present invention to provide a container of the above-mentioned type in which dynamic loads applied to the wall of the outer casing are diminished positively and without any notch effect.

According to the invention there is provided a container for the storage of radioactive material, comprising an inner casing for receiving the material and an outer casing made of a ceramic material that surrounds the inner casing, the inner casing being held within the outer casing by contact distributed over a large surface area of the inner wall of the outer casing, the contact being achieved solely by frictional engagement, by frictional engagement assisted by an adhesive or solely by an adhesive.

The acceleration forces are thereby transmitted over a large surface area of the outer casing uniformly and without notch effects on the inner casing.

The contact distributed over a large surface area can be achieved on the one hand by one or a few larger zones of contact, or by a plurality of smaller individual zones of contact distributed uniformly over the inner wall of the outer casing, as long as the total zone of contact necessary for securely holding the inner casing is obtained. The individual smaller zones of contact should not be so small that notch effects can occur. According to the invention the contact is achieved solely by friction engagement, by frictional engagement assisted by adhesive or solely by adhesive.

The outer wall of the inner casing may directly contact with the inner wall of the outer casing, or at least one contact element may be connected frictionally or in a form-locking manner to the inner casing, the outer wall of this contact element being in contact with the inner wall of the outer casing.

Should the outer wall of the inner casing directly contact the inner wall of the outer casing, then from the outset a large zone of contact, in particular a frictional engagement zone of contact, is achieved. In use of only one or a small number of contact elements, these may bear with larger zones of contact against the inner wall of the outer casing, so as to obtain a uniform transfer of the forces and a good heat transfer from the inner casing to the outer casing. In use of a plurality of contact elements, these may bear against the inner wall of the outer casing with their smaller individual zones of contact uniformly distributed, thus forming an excellent total zone of contact over a large surface area of the inner wall of the outer casing. In order to form a force locking connection between the inner casing and the outer casing in addition to frictional engagement welding, soldering or adhesive bonding may also be resorted to.

The outer wall of the inner casing or the outer wall or zones of contact of the contact element or the whole contact element are preferably produced from a metallic material, which guarantees good heat transfer from the inner casing to the outer casing. With frictional engagement contact, the magnitude of frictional engagement is determined by the choice of material.

In order to limit the tension resulting from the different coefficients of thermal expansion of the materials used for the outer casing and inner casing to acceptable levels, and in order to regulate the magnitude of the normal forces acting upon the inner wall of the outer casing, the outer wall of the inner casing or the frictional engagement element or each of the frictional engagement elements is preferably prestressed. When a frictional engagement is used as the contact element, this preferably consists of a slotted sleeve and an abutment connected to the inner casing. The sleeve can be prestressed in the peripheral direction, so that its outer surface bears with a defined force against the outer casing. Other contact elements which can be prestressed are described in the following description.

The abutment may be formed integrally with the sleeve or can be connected thereto by welding, soldering, adhesive bonding etc. In use of other types of frictional engagement element, care should be taken that prestressing can be impressed on them in such a way that they act upon the inner wall of the outer casing with predetermined normal force.

If no separate frictional engagement element nor a plurality of such frictional engagement elements is used, then the wall of the inner casing is preferably provided with at least one corrugation or the like extending in the longitudinal direction, this corrugation opening on the outer surface of the inner casing. The outer wall of the inner casing then bears against the inner wall of the outer casing and the adjustable prestressing can be predetermined by the design of the corrugation.

The inner cross-section of the outer casing and the outer cross-section of the inner casing may be cylinder-like, all bodies which are not limited by a polygonal surface being included in the term "cylinder-like", that is the application is not particularly limited to circular cylindrical cross-sections. Variations in the cylinder-like shape can occur, particularly on account of the material used for the outer casing and the manufacturing process used, which can be compensated for by using individual frictional engagement elements. When a plurality of essentially uniformly distributed frictional engagement elements is used, the frictional engagement elements can be formed individually and connect individually to the inner casing, or the frictional engagement elements can be formed integrally with one another at least in groups. Furthermore, when using a plurality of frictional engagement elements, it is preferably for these to be tongue-like in shape.

Unacceptable increases in the contact pressure of the inner casing or the frictional engagement element or elements on the inner wall of the ceramic outer casing due to thermal stresses are avoided when using a sleeve-like frictional engagement element by the corrugation or slot running in the axial direction which enables a circumferential contraction of the casing wall itself or of the frictional engagement element under thermal stress. When using a plurality of frictional engagement elements which extend in the longitudinal direction of the inner casing or are tongue-like in shape, no unacceptable increases in contact pressure occur. Instead of a frictional engagement element in the form of a slotted sleeve, a frictional engagement element comprising at least two sleeves fitting inside each other may be used in order to increase the frictional forces, the slots in the two sleeves being staggered in the circumferential direction. The sleeve and abutment can be formed integrally with each other or separately from one another.

It is of particular advantage for the inner wall of the outer casing to be formed in the shape of a truncated cone in the area of the frictional engagement, and for the outer wall of the inner casing or of the frictional engagement element to also be adapted to this configuration. When the surfaces in frictional contact are in the shape of truncated cones, the normal forces and thereby the frictional forces are progressively increased by movement of the sleeve in the case of stress in the axial direction, in that the initial stressing force is increased by compressing the sleeve or the inner casing in dependence on the angle of a truncated cone. The large end surfaces of the truncated cones may be adjacent to one end of the outer casing or to the middle of the outer casing.

If the large end surfaces of the truncated cones lie adjacent to on end of the outer casing and the corresponding zone of contact of the sleeve of the frictional engagement element is adapted to this configuration, then displacement of the frictional engagement element by wedging the sleeve of the frictional engagement element with the inner casing is limited if the displacement force is effective inside the container. If two frictional engagement elements are used and the inner wall of the outer casing is in the form of a double truncated cone generally corresponding in shape to the Diabolo toy, unacceptably large displacement of the inner casing and thereby stress on the base and the cover is prevented.

Frictional contact along the conical surface is also possible if separate frictional engagement elements are not used, but the outer wall of the inner casing and the inner wall of the outer casing must be shaped accordingly.

The inner casing can be held within the outer casing solely by frictional engagement over a large surface area of the inner wall of the outer casing; however, it is also possible for the frictional engagement to be assisted by an adhesive which does not impede the thermal behavior of the system. Ceramic adhesives are particularly suitable for this purpose, as is explained in more detail below.

Figure 2:
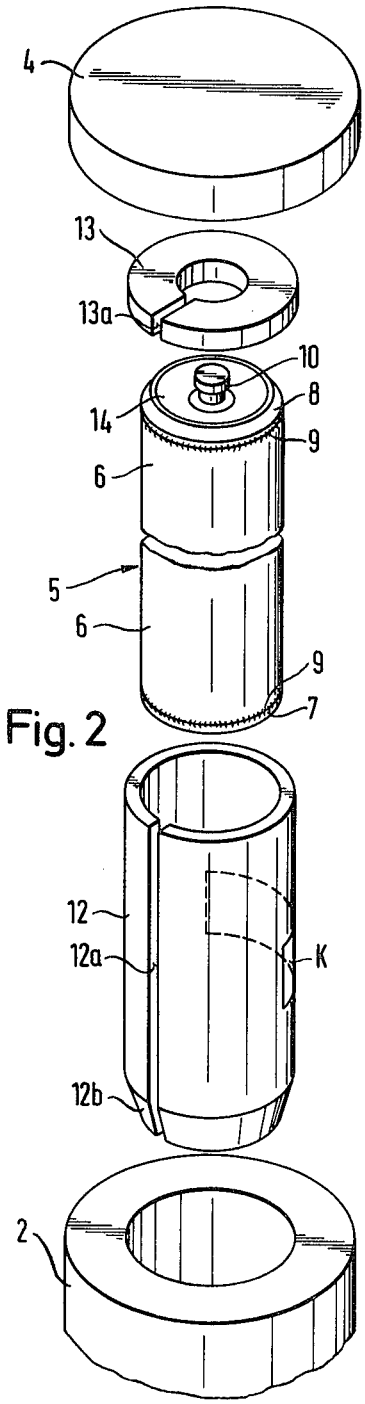
Figure 3:
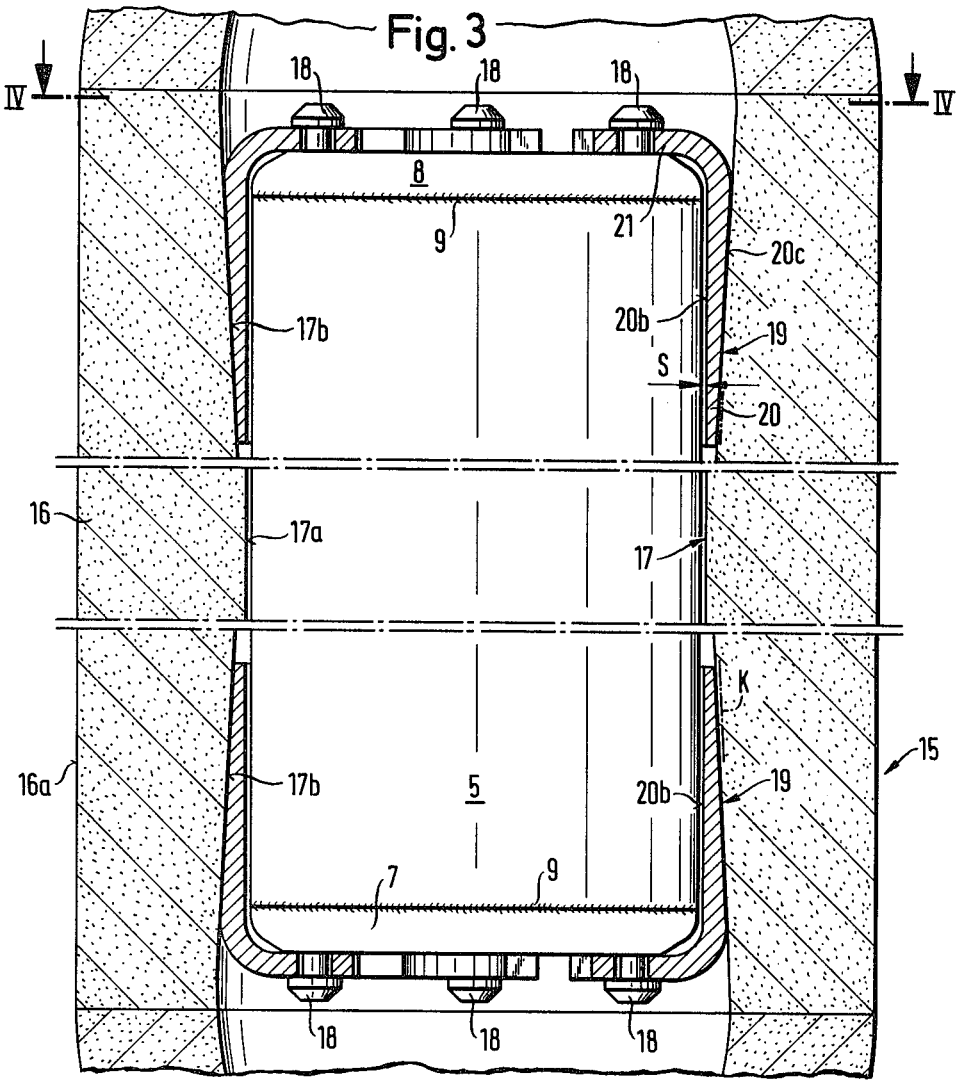
Figure 4:
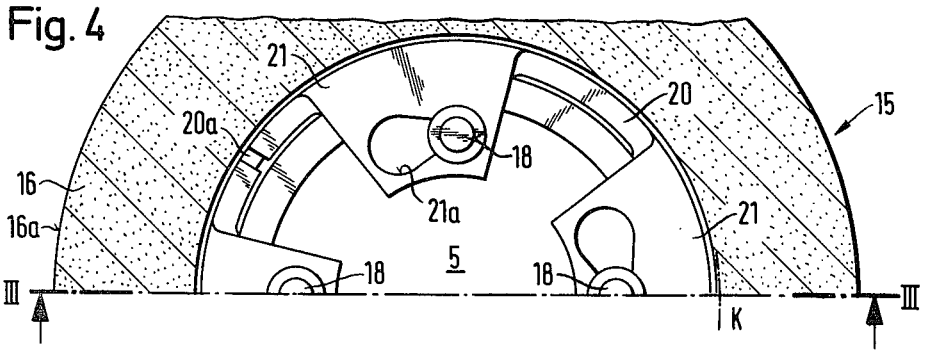
Figure 5:
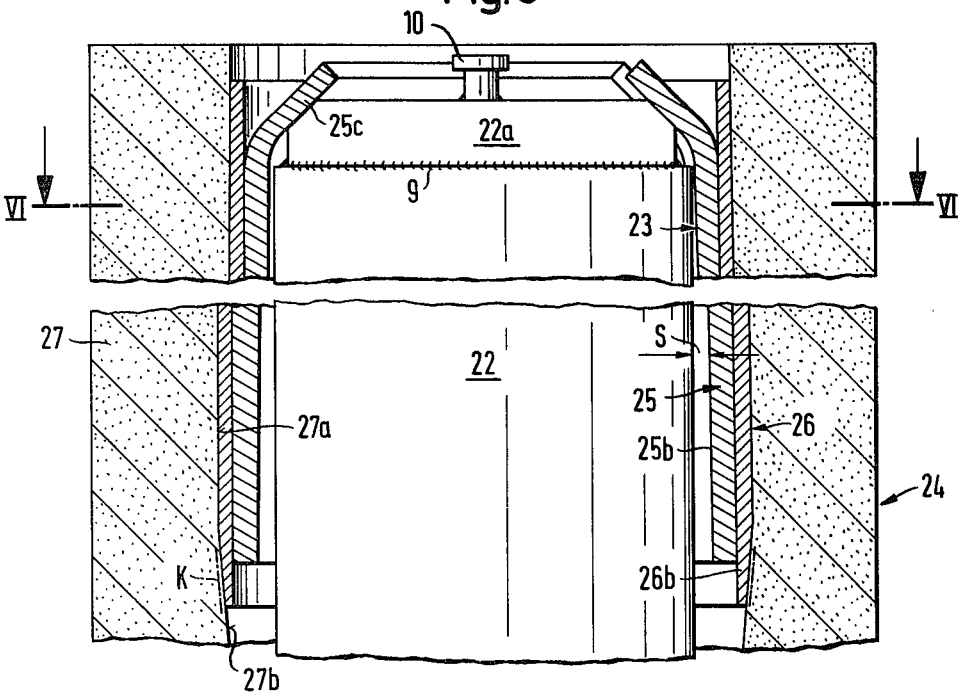
Figure 6:
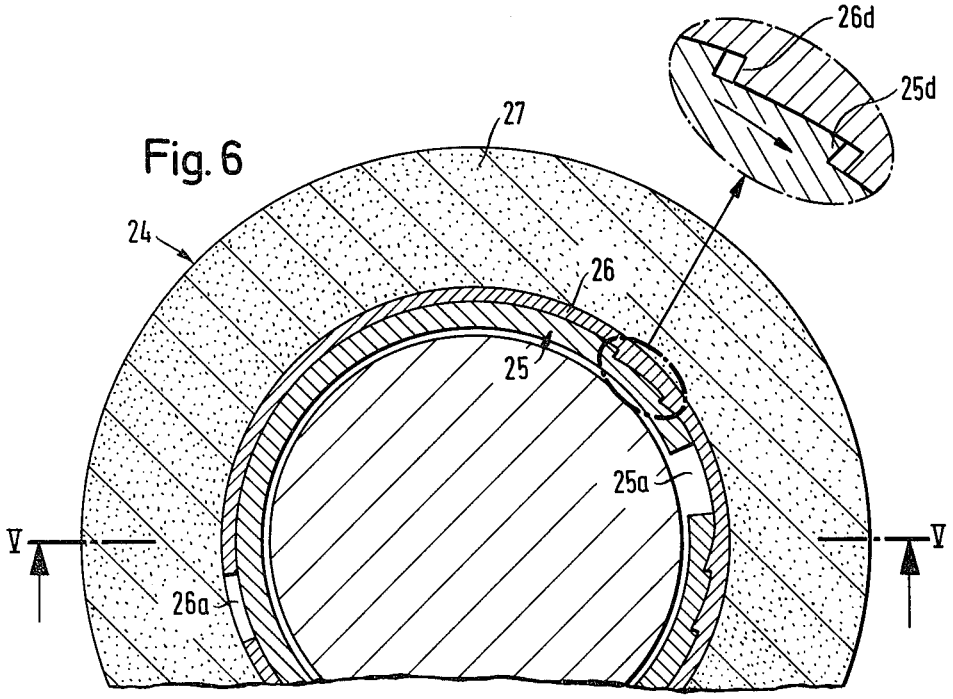
Figure 9:
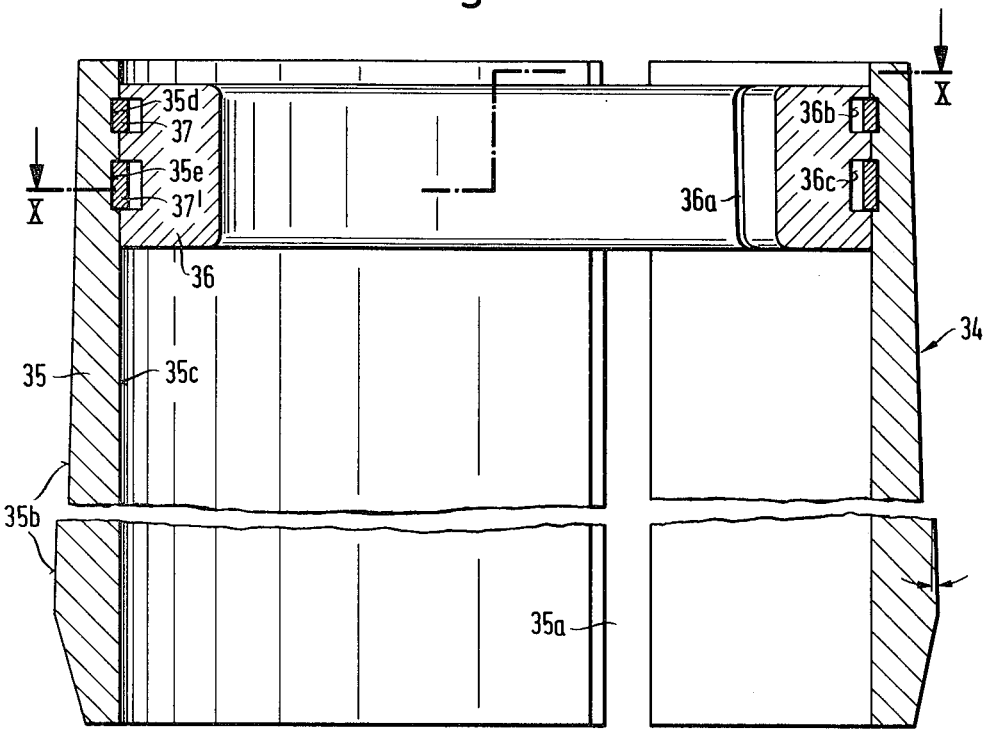
Figure 10:
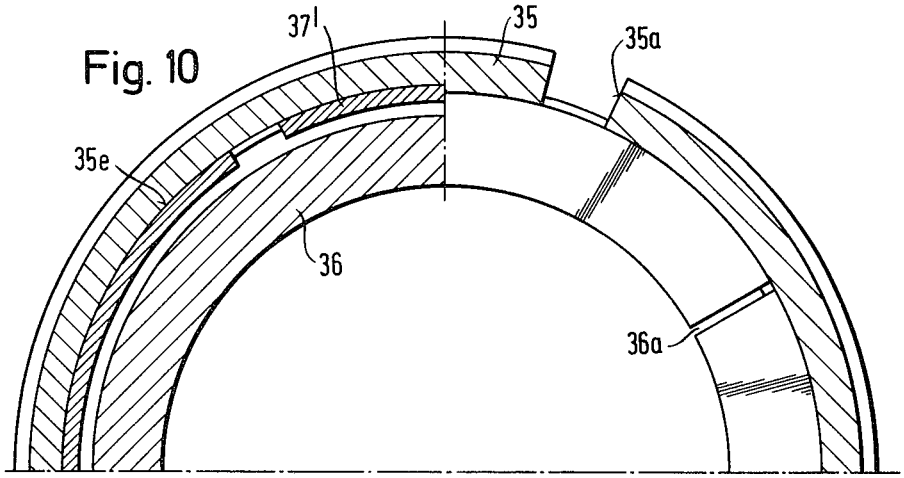
Figure 11:
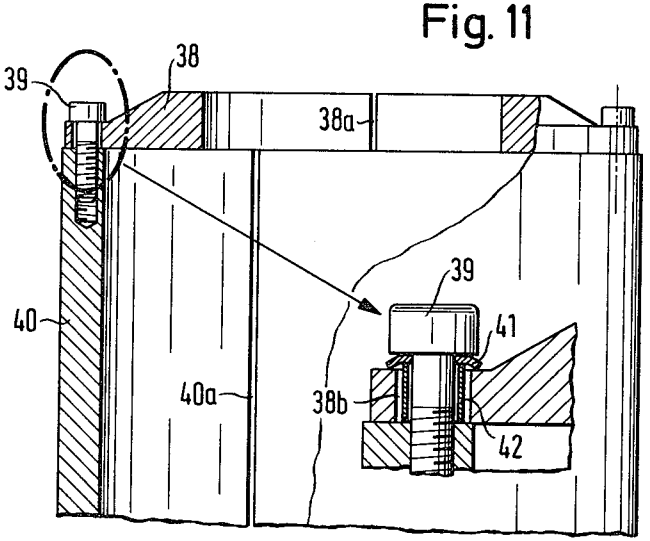
Figure 12:
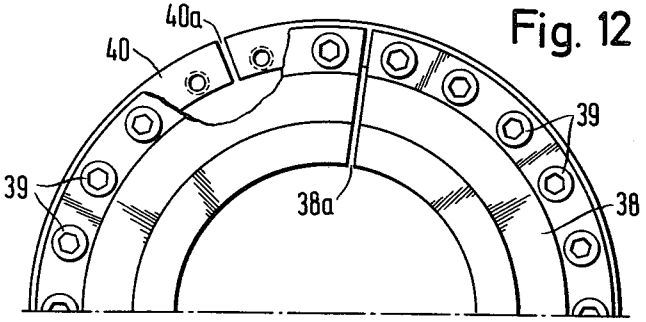
Figure 13:
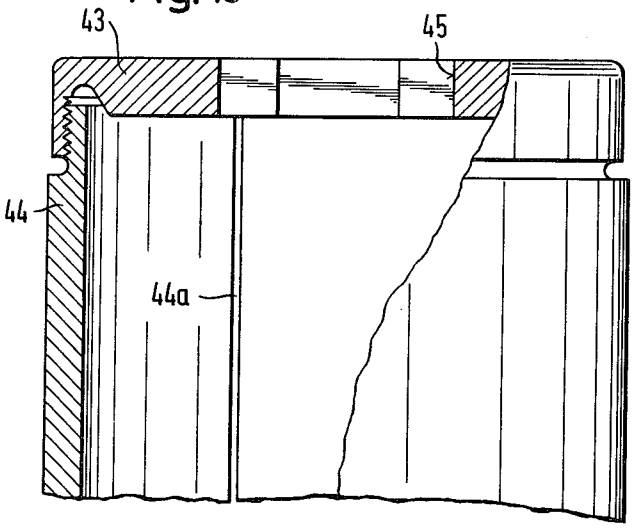
Figure 14:
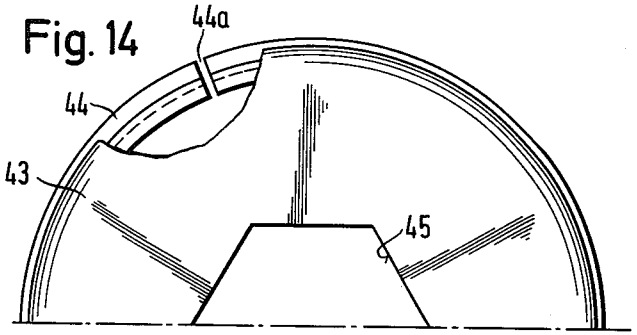
Figure 17:
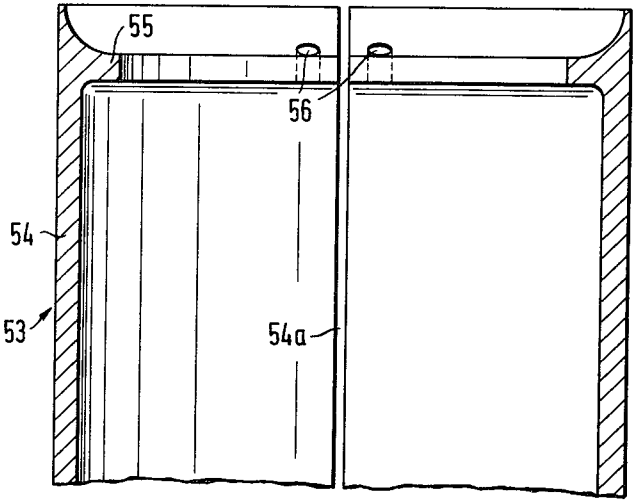
Figure 18:
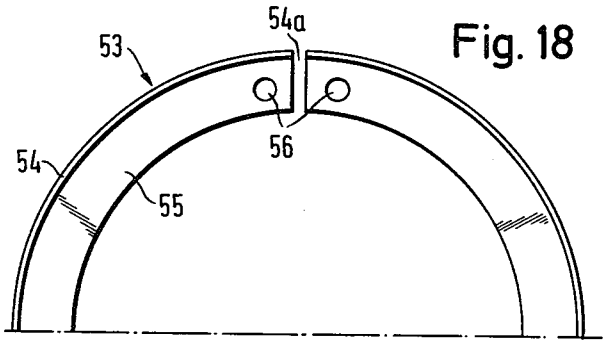
Figure 15:
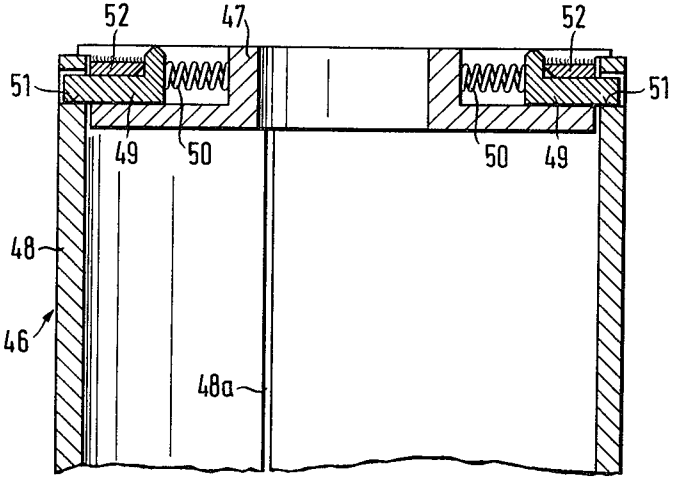
Figure 16:
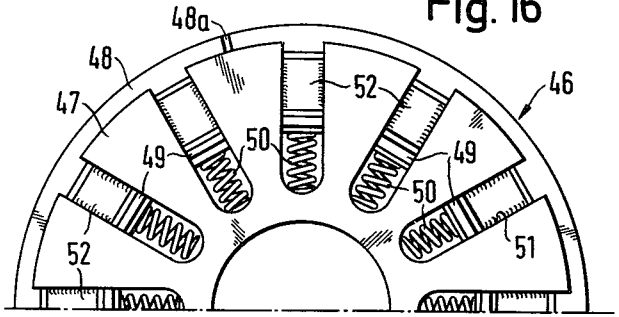
Figure 20:
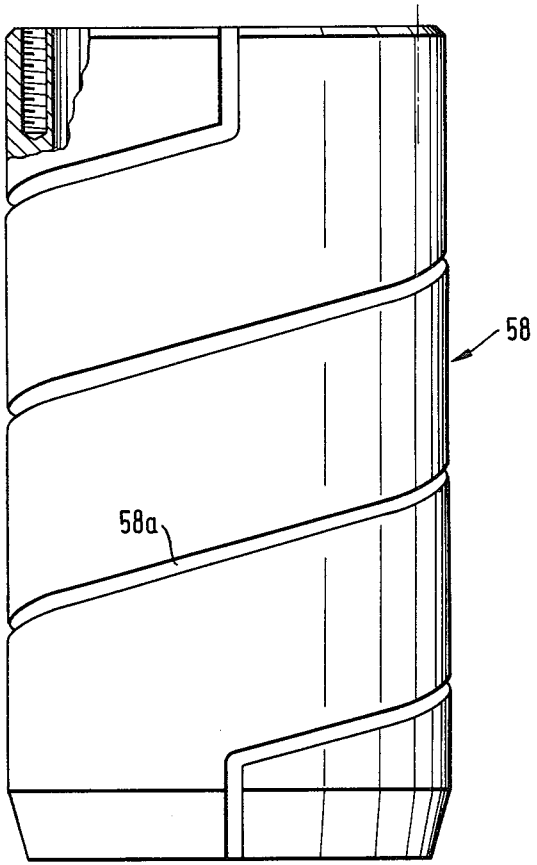
Figure 19:
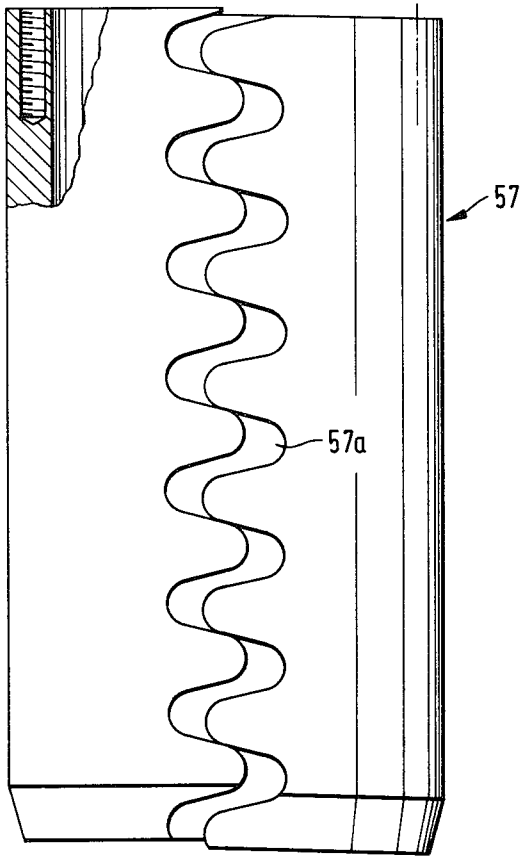
Figure 21:
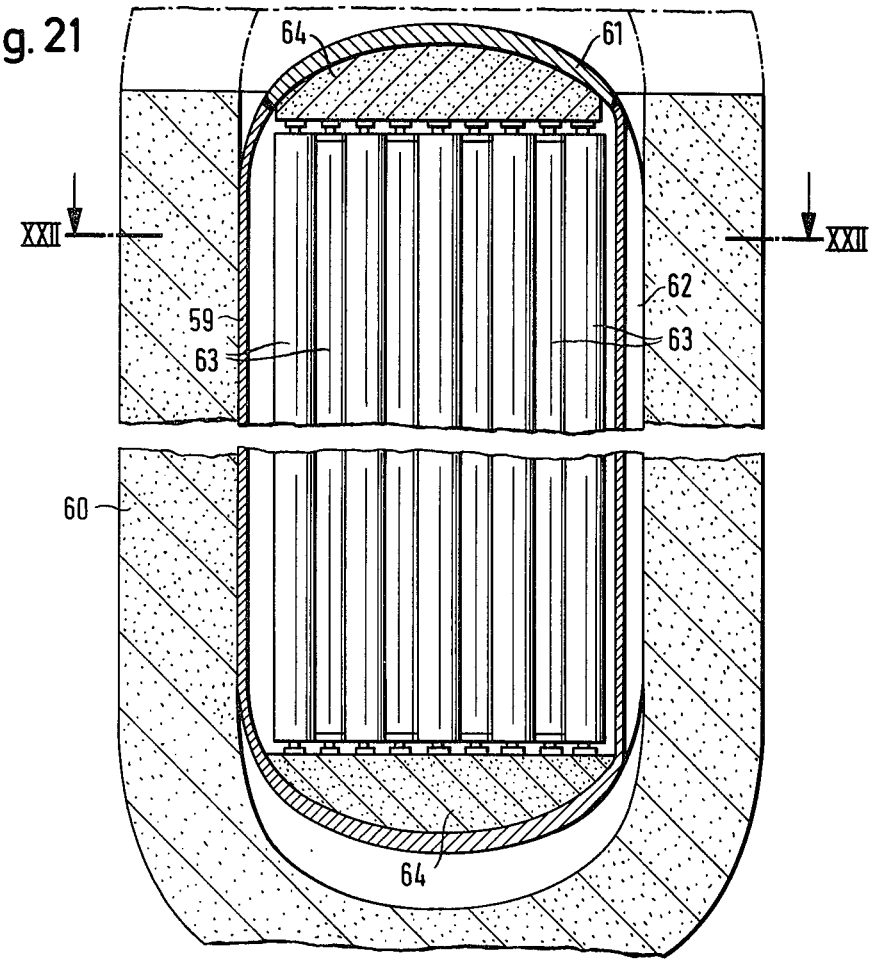
Figure 22:
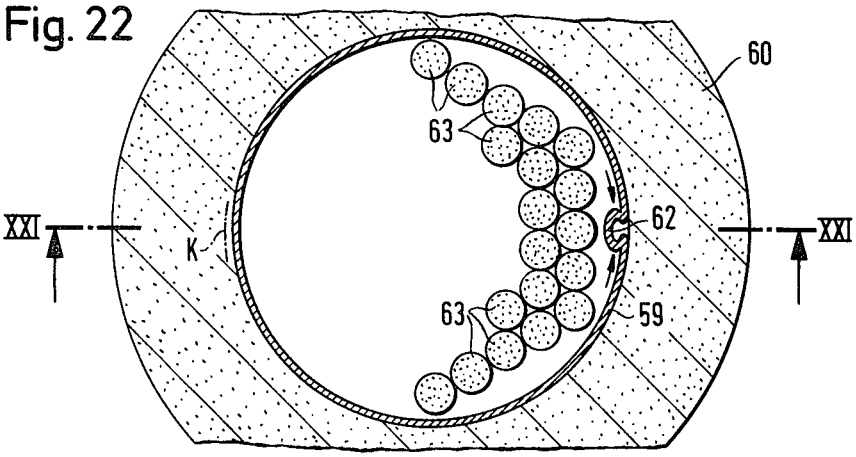
Figure 23:
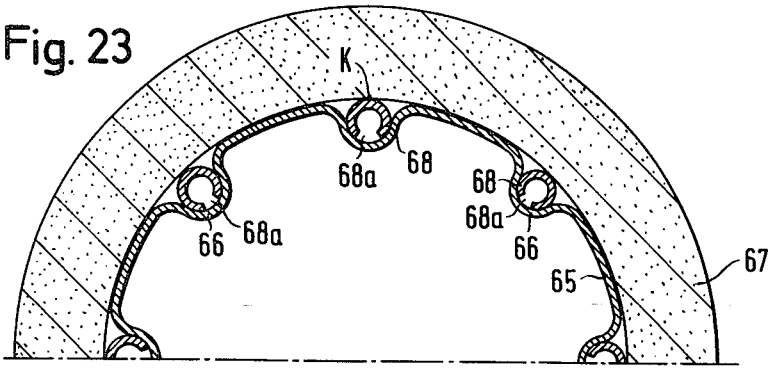
Figure 24:
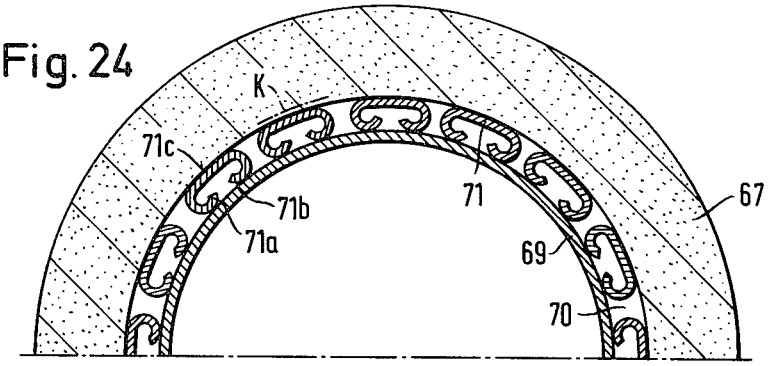
Figure 25:
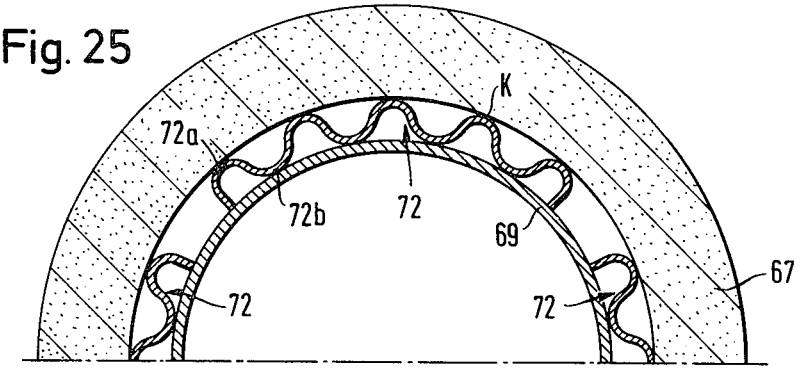
Figure 26:
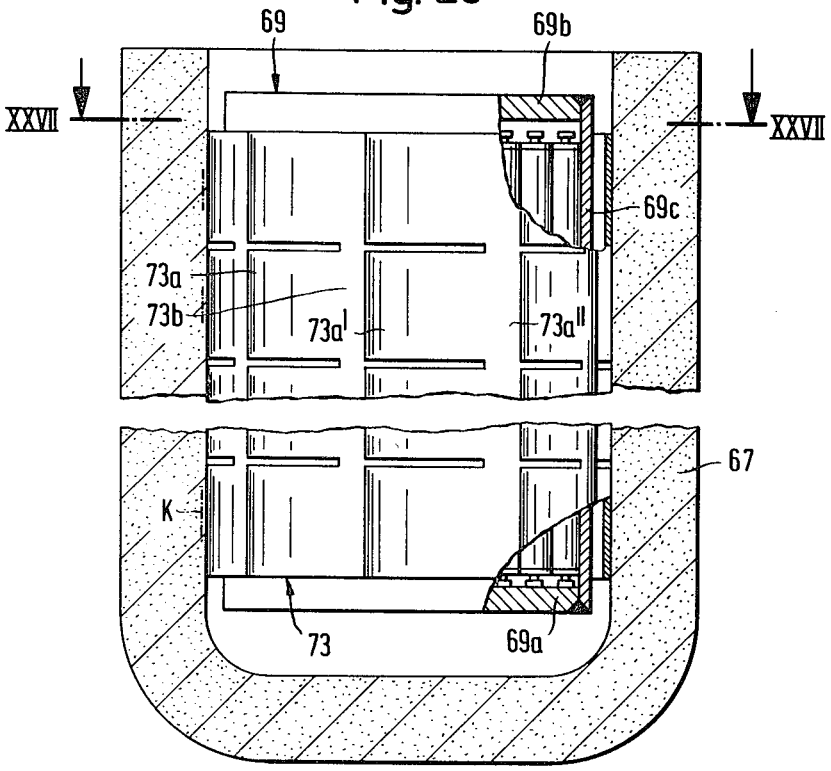
Figure 27:
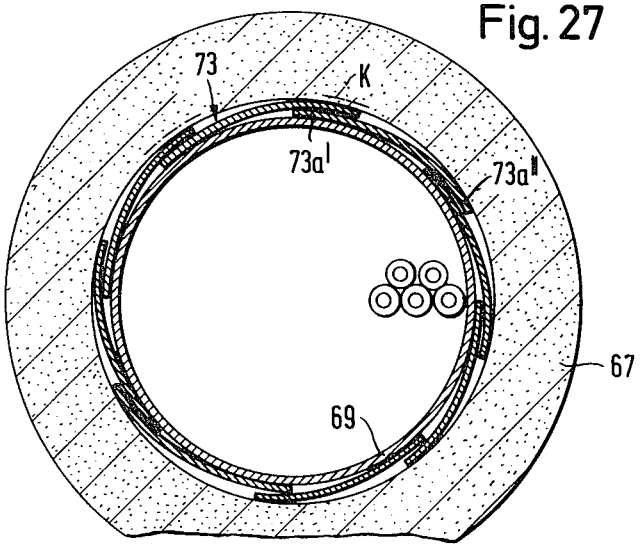
Figure 28:
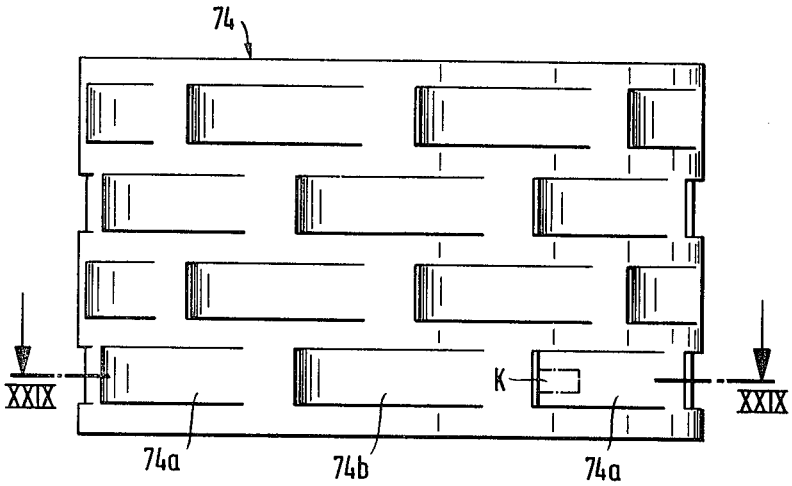
Figure 29:
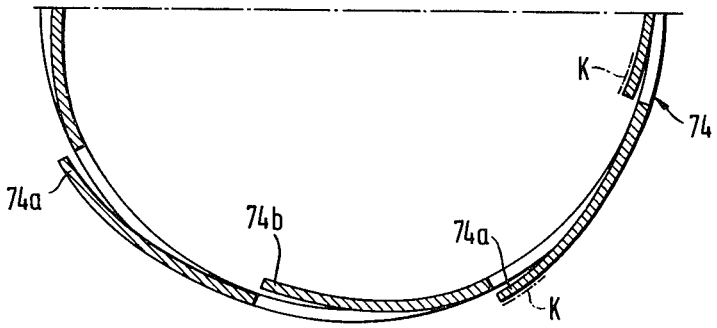
Figure 30:
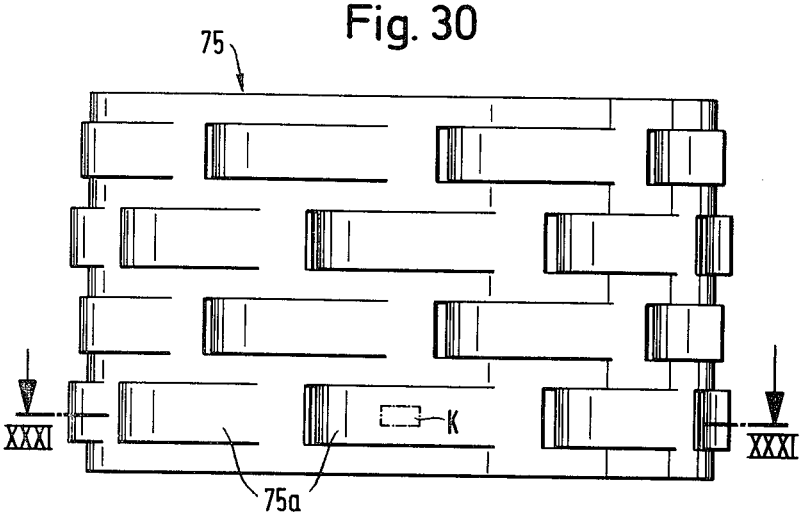
Figure 31:
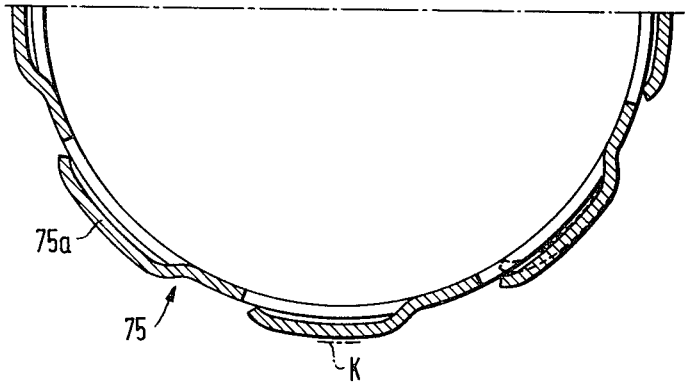
Figure 32:
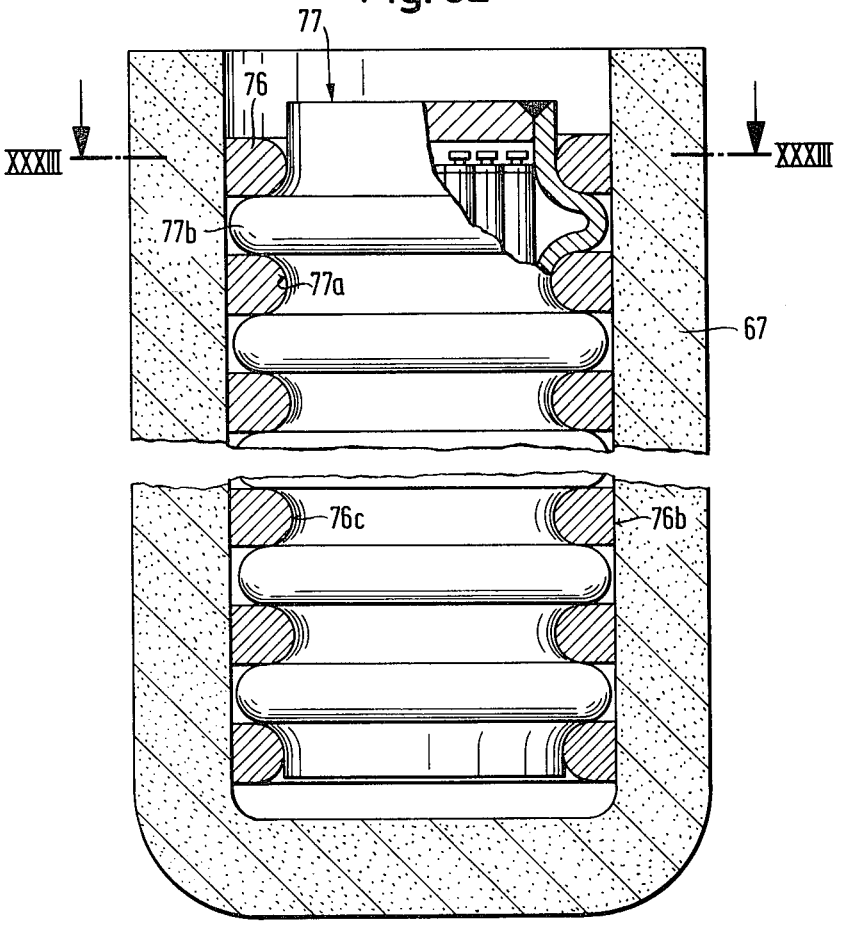
Figure 33:
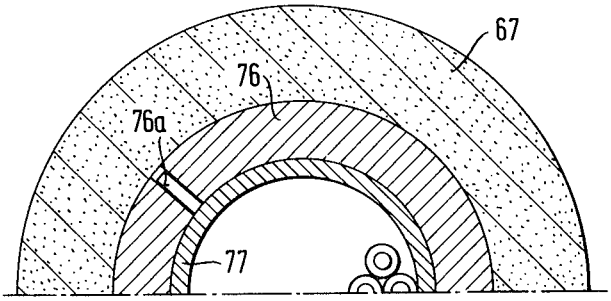

In order that the invention may be more fully understood, various embodiments of the invention will now be described, by way of example, with reference to the accompanying drawings, in which:

FIG. 1 shows upper and lower parts of the outer casing and frictional engagement elements of a first embodiment in longitudinal section, and of the inner casing in side view, FIG. 2 shows the sequence of assembly of the container of FIG. 1, FIG. 3 is a longitudinal section taken along the line 3—3 in FIG. 4 through the outer casing and frictional engagement elements of a second embodiment, FIG. 4 is a part-section taken along the line 4—4 in FIG. 3, FIG. 5 is a corresponding section to that shown in FIG. 3 through part of a third embodiment, FIG. 6 is a part-section taken along the line 6—6 in FIG. 5 with an enlarged illustration of the ratchet contact between the inner sleeve and the outer sleeve of a two-piece frictional engagement element, FIG. 7 is a section taken along the line 7—7 in FIG. 8 through parts of a further embodiment, FIG. 8 is a part-section taken along the line 8—8 in FIG. 7, FIG. 9 is a section through parts of a further embodiment incorporating frictional engagement elements, FIG. 10 is a part-section taken along the line 10—10 in FIG. 9, FIG. 11 is a side view shown partly in section of part of a further embodiment incorporating frictional engagement elements with an enlargement of the bolt connection between a sleeve and an abutment ring, FIG. 12 is a partly cut-away view of the embodiment of FIG. 11 from above, FIG. 13 is a side view shown partly in section of a part of a further embodiment incorporating frictional engagement elements, FIG. 14 is a partly cut-away view of part of the embodiment of FIG. 13 from above, FIG. 15 is a section through part of a further embodiment incorporating frictional engagement elements, FIG. 16 is a view of part of the embodiment of FIG. 15 from above, FIG. 17 is a section through part of a further embodiment incorporating frictional engagement elements, FIG. 18 is a view of part of the embodiment of FIG. 17 from above, FIG. 19 is a partly cut-away side view of a slotted casing section having a wavy slot, FIG. 20 is a similar view of a further slotted casing section having a helical slot, FIG. 21 shows upper and lower parts of a further embodiment partly in section taking along the line 21—21 in FIG. 22, in which the outer wall of the inner casing bears directly against the inner wall of the outer casing, FIG. 22 is a part-section taking along the line 22—22 in FIG. 21, FIG. 23 is a part-section through the inner casing and outer casing of a further embodiment with slotted frictional engagement tubes inserted longitudinally in corrugations in the inner casing, FIG. 24 is a similar view of an embodiment with an essentially straight cylindrical inner casing and outer casing in which prestressing elements extending axially are uniformly distributed in an annular arrangement between the two casings, FIG. 25 is a similar view of an embodiment, comparable to the embodiment shown in FIG. 24, in which frictional engagement elements which are corrugated in the circumferential direction and which extend longitudinally are disposed between the two casings, FIG. 26 shows upper and lower parts of a further embodiment partly in section in which comb-like frictional engagement elements are attached to the outer surface of the inner casing and bear against the inner wall of the outer casing, FIG. 27 is a part-section taken along the lines 27—27 in FIG. 26, FIG. 28 is a side view of a frictional engagement element incorporating tongues protruding outwardly and tongues protruding inwardly for holding the frictional engagement element on the inner casing, FIG. 29 is a part-section along the line 29 —29 in FIG. 28, FIG. 30 is a side view of a further embodiment of frictional engagement element having frictional engagement tongues protruding outwardly, FIG. 31 is a part-section along the line 31—31 in FIG. 30, FIG. 32 shows upper and lower parts partly in section of an embodiment in which a bellows-like inner casing is held within an essentially straight cylindrical outer casing, and FIG. 33 is a part-section taken along the line 33—33 in FIG. 32.

In the container according to FIG. 1, the outer casing 1 made of a ceramic material consists of a cylindrical housing 2, a base 3 and a cover 4, the base 4 and cover 4 being suitably connected to the end surfaces of the housing 2.

The inner casing 5 is disposed within the outer casing, this inner casing 5 consisting of a cylindrical housing 6, a base 7 and a cover 8. In the embodiment shown, the inner casing 5 is made of metal, the base 7 and cover 8 being connected to the housing 6 along welded seams 9. (It is also possible for the housing 6 and base 7 to be in the form of a single deep drawn unit). The inner casing 5 is filled with radioactive material emitting heat by a method which will not be described in detail.

A manipulating pivot 10 is attached to the cover 8 to facilitate handling of the inner casing 5.

The inner casing 5 is held within the outer casing 1 by two frictional engagement elements 11 for transferring the dynamic forces acting upon the inner casing 5 to the ceramic wall of the outer casing 1.

Each frictional engagement element 11 consists of a sleeve 12 provided with an elongate slot 12*a* and an end ring 13 provided with a slot 13*a* which can be connected to the sleeve 12 by means of a variety of connection methods. A bolt connection is an example of a possible connection method.

The sleeves 12 surround the inner casing 5 in the assembled container with a specified clearance S. The base 7 of the inner casing 5 is supported by a spring washer 14 on the end ring 13 of the lower frictional engagement element, and the cover 8 is supported by a spring washer 14 on the end ring 13 of the upper frictional engagement element, and the manipulating pivot 10 extends into an aperture in the end ring 13 of the upper frictional engagement element.

The assembly of the upper section of the container is shown in more detail in FIG. 2.

The sleeves 12 can be reduced in diameter by means of a clamping tool which is not shown, by decreasing the diameter of the width of the slot 12*a* to such an extent that it can be inserted into the cylindrical housing 2. The dimensions are chosen so that, after the tool has been withdrawn from the lower sleeve 12, the tool rests against the inner wall of the outer casing 1 with a defined radial initial stress. The inner casing 5 is then inserted (it being assumed that the lower frictional engagement element is already assembled) until it rests on the lower spring washer 14. Then the upper spring washer 14 is inserted and the end ring 13 is connected to the end of the upper sleeve 12 with the slots 12*a* and 13*a* aligned.

As can be seen from FIG. 1, the end rings 13 are spaced from the base 3 and the cover 4.

When the container is accelerated in the axial direction of the container, the inner casing 5 is held in such a way that the base 3 and cover 4 of the outer casing 1 are not exposed to any shock loading, since the end rings 13 serve as abutments which absorb the axial forces and transfer them to the housing 2 (obviously the connections between the sleeves 12 and end rings 13 must be such that it is guaranteed that these forces will be transferred to the housing 2). The forces are transferred to the ceramic material via the friction contact over a large surface area between the outer surface of the sleeves 12 and the inner wall of the cylindrical housing 2, without the ceramic material being subjected to shock loading or notch effects.

The container is arrange in such a way that, after the clamping tool has been withdrawn, the sleeves 12 act upon the cylindrical inner surface of the housing 2 with the desired force, and also such that the radial slot 12*a* is not closed but still has a specified width of slot. Thus an unacceptable increase in the contact pressure of the sleeves 12 on the cylindrical housing 2 due to thermal stresses resulting from the different coefficients of thermal expansion can be avoided.

To facilitate the insertion of the frictional engagement elements 11 into the cylindrical housing 2, the lower ends of the sleeves 12 are formed as truncated cones 12*b*.

No special treatment, or at most a green horn treatment, of the ceramic outer casing 1 is required for fixing the inner casing 5 within the outer casing 1.

In the outer casing 15 shown in the embodiment of FIGS. 3 and 4, the housing 16 has a straight cylindrical outer surface 16*a*, while the inner surface 17 consists of an axial straight cylindrical section 17*a* and two surface sections 17*b* in the form of truncated cones diverging outwardly. The base and cover of the outer casing 15 each form a dome, thus differing from the embodiment according to FIG. 1. The shape of the base and cover is not critical in the case of the present invention.

The same reference numerals have been used for the inner casing in FIGS. 3 and 4 as in the embodiment of FIGS. 1 and 2. Four locking pins 14 are provided on the base 7 and cover 8, distributed uniformly round the circumference and serving as manipulation pins.

The frictional engagement elements 19 are each formed in one piece and consist of a sleeve 20 provided with a slot 20*a* and abutment portions 21 which overlap the base 7 and cover 8, as is shown in FIGS. 3 and 4. The inner surface 20*b* of each sleeve 20 is in the form of a straight cylinder, whilst the outer surface 20*c* is in the shape of a truncated cone having the same frustum angle as the corresponding surface section 17*b* which is also in the form of a truncated cone. When assembled, there is a clearance S between the inner surface 20*b* and the outer surface of the inner casing 5. A locking opening 21*a* (see FIG. 4) is provided in each abutment portion 20, so that, after the frictional engagement element 19 has been placed on the inner casing and after corresponding rotation of the frictional engagement element in relation to the inner casing, the two components may be connected together in a form-locking manner so as to prevent axial separation. It should furthermore be noted that the surface section 17*a* can be relatively long, and the configuration of the two outer surfaces 20*c* can be compared to the Diabolo toy in which a rotational body is used having a corresponding double truncated cone configuration. When the container is subjected to axial acceleration forces, considering the upper part of FIG. 3 by way of example, the frictional engagement between the outer surface 20*c* of the upper frictional engagement element 19 and the surface section 17*b* of the outer casing 15 is progressively increased, since the normal force acting upon the surface section 17*b* is increased by compression of the sleeve 20 by an amount which depends on the angle of the truncated cone surfaces which are in contact. The amount by which the sleeve 20 is compressed is preferably limited by the specified width of the slot 20*a* or by reduction of the clearance S between the inner surface 20*b* on the outer surface of the inner casing 5. Which method is effective depends on the width of the slot and its size in comparison to the clearance S.

In the embodiment shown in FIGS. 5 and 6, an inner casing 22 with graduated ends is held within an outer casing 24 by means of two-piece frictional engagement elements 23. Each two-piece frictional engagement element consists of an inner sleeve 25 and an outer sleeve 26 which are provided with elongated slots 25*a* and 26*a*. The two sleeves 25 and 26 are placed inside each other in such a way that the slots 25*a* and 26*a* are staggered. In the embodiment shown, the slots are essentially diametrically opposite to each other.

The inner sleeve 25 consists of a section 25*b* in the form of a truncated cone and an abutment collar 25*c* also in the form of a truncated cone and integral with the section 25*b*, the abutment collar resting with its inner surface against a corresponding chamfer on the stepped section 22*a* of the graduated inner casing 22. In comparison to the sleeve 20 of the frictional engagement element 19 according to FIGS. 3 and 4, in this embodiment the sleeve section 25*b* in the form of a truncated cone has a uniform wall thickness, so that the clearance S between the cylindrical outer surface of the inner casing 22 and the truncated cone-shaped inner surface of the sleeve section 25*b* increases inwardly. The outer surface of the sleeve section 25*b* bears against the inner surface of the truncated coneshaped outer sleeve 26 which also has an essentially uniform wall thickness.

The outer surface of the outer sleeve 26 which is also in the shape of a truncated cone rests against a truncated cone-shaped surface section 27*a* of the outer casing housing 27, the cover and base of which are not shown.

By using the two slotted sleeves which are placed inside each other, the frictional forces can be increased in comparison with the use of only one slotted sleeve. If the frictional forces between the two sleeves 5 and 26 are adequate, the outer surface of the outer sleeve 26 can be fixed to the surface 27*a* adhesive bonding welding. In that case, the outer sleeve 26 could then be considered as constituting the inner wall of the outer casing in regard to the frictional engagement contact.

Of course, the inner casing does not have to be graduated. It is easier to construct it from two cylindrical sections. The truncated conical surface 27*a* diverges inwardly until it meets a surface 27*b* which behaves the opposite way and which for its part then meets a straight cylindrical surface (not shown). The leading truncated conical section 26*b* of the outer sleeve 26 corresponds to the angle of inclination of the surface 27*b*.

When the outer sleeve 26 is secured in position, it provides protection for the inner wall of the ceramic outer casing.

With an outer sleeve which is not secured to the outer casing, in order to prevent a compression of the outer casing with the chosen truncated conical configuration, or to limit it to a certain level, the inner sleeve 25 may be provided with a toothed construction 25*d* on a section of its circumference along its whole axial length or only a part of its axial length, this toothed construction meshing with a corresponding toothed construction 26*d* on the inner surface of the outer sleeve 26. The enlarged illustration in FIG. 6 shows a situation in which interlocking contact between the two toothed constructions 25*d* and 26*d* has not been reached, whereas, in the main drawing of FIG. 6, the interlocking contact has already been made. When the outer sleeve is compressed, due to the keying effect relative movement between the outer sleeve 26 and inner sleeve 25 results in the direction of the arrow shown in the enlarged illustration, until the teeth surfaces of the two locking toothed constructions come together.

In the embodiment of FIGS. 7 and 8, an inner casing 28 is used together with the outer casing 24 according to FIG. 5. A contact surface is provided on the welded cover 29 of the inner casing 28 which is in the form of a truncated cone converging outwardly. Each frictional engagement element 30 consists of a slotted sleeve 31 and an abutment ring 32 which, when assembled, has a conical contact surface 32*a* which comes into contact with the conical surface 29*a*. In the graduated slot 31*a* of the sleeve 31, a limiting sheet 33 attached to the outer surface of the inner casing 28 extends with limiting clearance BS. This limiting sheet 33 limits the circumferential contraction of the sleeve 31 by axial displacement of the frictional engagement element to a specified level at which the free edges of the elongate sheet 33 come into contact with the graduations of the slot 31*a*.

A further type of frictional engagement element 34 is shown in FIGS. 9 and 10, consisting of a sleeve 35 and an annular abutment 36 which, due to the truncated cone shape of the outer surface 35*b* of the sleeve 35, also operates progressively. The abutment 36, which incorporates a continuous slot 36*a*, is also provided with two annular slots 36*c* in its cylindrical housing surface which have different axial widths. Two annular slots 35*d* and 35*e* are also formed in the cylindrical inner surface 35*c*, being spaced equidistantly to, and having the same axial lengths as, the slots 36*b* and 36*c*. Spring washers 37 and 37' are disposed in the slots, so that, when the frictional engagement element is assembled, the spring washers 37, 37' engage the slots 36*b*/35*d* and 36*c*/35*e*, and thereby lock the abutment ring 36 with the sleeve 35 so as to transfer the dynamic forces to the sleeve 35. The differing axial widths of the slots and the spring washer result in a well-defined arrangement of the spring washers in the slots.

In the embodiment according to FIGS. 11 and 12, an abutment ring 38 provided with a slot 38*a* is connected to a sleeve 40 provided with a slot 40*a* by means of bolts 39. As can be seen from the detailed drawing, the bolts 39 extend through boreholes 38*b* so as to permit the necessary heat transfer. The bolt head is supported on the abutment by a spring washer 41 and is surrounded by a protective sleeve 42 in the borehole 38*b*.

In the embodiment according to FIGS. 13 and 14, a cover-like abutment 43 of a friction engagement element is screwed on to a sleeve 44 provided with a slot 44*a* by means of a screwthreaded connection which is not free from play. To enable rotary motion to be applied thereto by means of a suitable tool, a hexagonal control opening 45 is provided in the coverlike abutment 43.

In the embodiment according to FIGS. 15 and 16, an abutment 47 is connected to a sleeve 48 in a form-locking manner by means of lock bolts 49 which are held in their locking position in recesses 51 in the sleeve 46 by springs 50. In order to connect the abutment 47 to the sleeve 48, the lock bolts 49 are drawn back by a suitable tool against the initial stress of the springs 50 and the abutment 47 is lowered until the front surfaces of the lock bolts 49 stand opposite the openings 51. When the lock bolts 49 have been released they are pushed into the openings 51 by the springs 50 until they contact safety bridges 52 connected to the abutment 47 (for example, by welding).

FIGS. 17 and 18 show a particularly simple embodiment, in which the sleeve 54 and the abutment 55 are produced in one piece. A slot 54*a* is provided in both the sleeve 54 and the abutment 55. Contact boreholes 56 into which a clamping tool can be engaged are provided in the abutment 55 on both sides of the slot 54*a*. The frictional engagement element 53 is prestressed by the tool by decreasing the width of the slot 54*a* and is then introduced into an outer casing which is not shown.

In FIGS. 19 and 20, sleeves 57 and 58 are shown which are provided with slot configurations which differ from the hitherto rectilinear slots. The sleeve 57 is provided with a wavy slot 57*a* of the shape shown in FIG. 19, in the manner of a clamping sleeve. The abutment, which is not shown, must be arranged in such a way that, when the abutment is fixed to the sleeve, the initial stressing applied to the sleeve is not altered in any undesirable way.

Considering the sleeve shown in FIG. 20, a slot 58*a* runs first in the axial direction and then follows a helical path around the sleeve. It again runs in the axial direction in the vicinity of a leading truncated conical portion of the sleeve 58.

FIGS. 21 and 22, an embodiment of container according to the invention is shown in which a separate frictional engagement element is not used, but the outer wall of an inner casing 59 bears directly against the inner wall of an outer casing 60. The inner casing 59 is a drawn out casing which is sealed to a cover 61 by welding. The casing 59 is provided with a corrugation 62 which extends inwards and opens outwards. The corrugation 62 can be made directly during manufacture of the casing 59 or it can be made separately and then welded into the casing. The way the corrugation 62 works to provide the necessary frictional engagement can be compared with the slots in the previously described embodiments. The circumferential length of the inner casing 59 can be decreased by a tool operating as shown by the arrows in FIG. 22, and the inner casing 59 can then be inserted into the outer casing 60. After withdrawal of the tool, the inner casing 59 bears against the inner wall of the outer casing 60 under a specified prestressing. Some fuel rods 63 are indicated inside the inner casing 59, the remaining space being filled with padding material 64, and the inner casing 59 is closed by the cover 61.

Although in FIGS. 21 and 22 the outer wall of the inner casing 59 and the inner wall of the outer casing 60 are shown as being straight cylinders, truncated conical surfaces can also be used in such a configuration as so to progressively form the friction contact.

In the embodiment according to FIG. 23, the wall of the inner casing 65 is provided with a plurality of corrugations 66 uniformly distributed around the circumference. The outer wall of the inner casing 65 bears against the inner wall of the outer casing 67 in between the corrugations. However, it is not necessary for the inner casing 65 to lie against the outer casing 67 for the frictional engagement elements 68 provided to function. Slotted tube-like frictional engagement elements 68 are inserted in the corrugations 66 which extend at right angles to the plane of the drawing, in such a way that slots 68*a* in the elements 68 opens towards the bases of the corrugations 66 and the inner casing 65 bears against the inner wall of the outer casing 67. Therefore a frictional engagement contact results between the frictional engagement elements 68 and the inner casing 65 on the one hand and between these elements and the outer casing 67 on the other hand. When the inner casing 65 is subjected to thermal stress, greater thermal expansion can be absorbed by the inner casing 65 than by the outer casing 67, as the inner casing 65 can distort in the vicinity of the corrugations 66, whereby the frictional engagement elements 68 are simultaneously distorted.

A combination of the inner casing according to FIGS. 21 and 22 with the frictional engagement element 68 of FIG. 23 is also possible. In this case a frictional engagement element 68 inserted into a corrugation 62 of the inner casing 59 would operate like a spring element which attempts to open the corrugation and thus increases the frictional force on the inner casing.

In the embodiment according to FIG. 24, a straight cylindrical inner casing 69 lies within the outer casing 67. Several tube-like frictional engagement elements 71 are disposed in the annular space 70 between the two casings 67 and 69, these elements 71 preferably having a C-shaped cross-section in which the two free ends 71*a* and 71*b* of the elements curl inwards, whilst the backs 71*c* of the elements bear against the inner wall of the outer casing 64.

Thermal expansion of the inner casing 69 is absorbed by flexible distortion of the frictional engagment elements 71.

In the embodiment according to FIG. 25, corrugated frictional engagement elements 72 are disposed in the annular space between the outer casing 67 and the straight cylindrical inner casing 69, and the peaks 72*a* of these elements bear against the inner wall of the outer casing 67 and the troughs 72*b* bear against the outer wall of the inner casing 69. The frictional engagement elements 72 can be flexibly distorted so as to produce a specified frictional engagement contact force. The flexible deformability also guarantees absorption of thermal stresses.

In the embodiments according to FIGS. 23 to 25, either frictional engagement elements can be used which essentially extend over the whole length of the inner casing, or shorter frictional engagement elements can be inserted one after another and, in the cases of FIGS. 24 and 25, eventually displaced.

In the embodiment according to FIGS. 26 and 27, the straight cylindrical inner casing 69, which consists of a base 69*a*, a cover 69*b* and a housing 69*c*, is held by means of eight comb-like frictional engagement elements 73. The frictional engagement elements 73 consist of a plurality of frictional engagement tongues 73*a* which when flexibly distorted rest with their top area 73*a'* bearing against the inner wall of the outer casing 67. The bottom areas 73*a''* of the tongues form a common ridge 73*b* which bears against the outer wall of the inner casing 69 and is, for example, welded to the outer wall, prior to the inner casing 69 being inserted into the outer casing 67. The inner casing 69 fitted with the frictional engagement elements 73 can be inserted into the outer casing by rotation (anti-clockwise in FIG. 27). Then under initial stress the outer surfaces of the frictional engagement tongues 73*a* will lie against the inner wall of the outer casing 67. The frictional engagement elements 73 are preferably made from spring steel. Individual tongues 73*a* which are separate from one another could also be connected to the outer wall of the inner casing 69.

FIGS. 28 and 29 show a frictional engagement cage 74 which is suitable for holding an essentially straight cylindrical inner casing 69 within an outer casing 67. The frictional engagement cage 74 is preferably made of spring steel and incorporates punched-out frictional engagement tongues 74*a* which provide the frictional engagement contact with the inner wall of the outer casing 67. Retaining tongues 74*b* are formed between the outer frictional engagement sealing tongues 74*a* and these bear against the inner casing 69 during frictional engagement or are connected to the casing 69 by welding, gumming etc. In order to distribute the friction contact uniformly on the inner wall of the outer casing 67, the frictional engagement tongues 74*a* are distributed uniformly over the outer surface of the frictional engagement cage 74.

FIGS. 30 and 31 show a further frictional engagement cage 75 which is provided only with frictional engagement tongues 75*a* protruding outwardly, and which can be connected over its inner surface to the inner casing 69. The top areas of the frictional engagement tongues 75*a* are radially bent inwards. There also exists the possibility of bending the tongue until its top area bears against the inner casing 69, so that the tongue can be supported on the inner casing 69 during initial stressing and/or thermal distortion.

After the frictional engagement cage has been attached to the inner casing, the inner casing with the frictional engagement cage can be inserted into the outer casing in a simple way by rotation. The axial length of the frictional engagement cage can correspond to the required friction closing contact length, or several shorter cages can be used. The cages can be provided with a longitudinal section running axially.

In the embodiment according to FIGS. 32 and 33, instead of a single frictional engagement sleeve several annular frictional engagement elements 76 provided with slots 76*a* are provided with their straight cylindrical outer surfaces 76*b* bearing against the inner wall of the outer casing 67. The rounded off inner surface 76*c* of each of the frictional engagement elements 76 is in contact with an annular corrugation 77*a* formed in an inner casing 77, the shape of which corresponds to the inner surface 76*c*. Between the annular corrugations 77*a* the inner casing 77 is provided with ridges 77*b* protruding outwardly, so that annular corrugations 77*a* and ridges 77*b* of the inner casing 77 alternate, that is the casing 77 has a bellows-like configuration, which can be seen particularly well in the sectional view of FIG. 32, the bellows housing being welded to a base and a cover. In this arrangement, the frictional engagement contact is distributed uniformly over the inner wall of the outer casing 67, whilst at the same time a good thermal adaptation and heat conduction between the inner casing 77 and outer casing 67 is guaranteed, and any variances in the straight cylindrical geometry of the diameter and/or cylindrical axis of the inner and/or outer casings can be absorbed. The above-mentioned advantages are also particularly achieved in the arrangements according to FIGS. 26 to 31. Instead of providing form-locking contact (see FIG. 1) or form-locking and tensional contact (see FIG. 5), the embodiments according to FIGS. 23 to 31 exhibit a purely tensional contact between the components, without the desired outer frictional engagement of the outer casing being endangered. If the frictional engagement of the inner casing is adequate, this does not need to be supported by special abutment portions.

As has already been mentioned, the frictional engagement contact may be assisted by an adhesive. The adhesive areas K must be arranged so that the thermal conditions of the system are not impeded. For example, possible adhesive areas are shown in the figures by dotted areas or lines.

Ceramic adhesives, such as those produced by the company Aremco Products, are particularly suitable as adhesives which are sufficiently resistant to heat and corrosion and which can withstand exposure to radioactivity. Such adhesives are based, for example, on aluminum oxide, zirconium oxide or magnesium oxide, and with regard to their binding properties they can consist of ceramic, graphite, quartz, bornitride, silicon oxide and metals such as steel, aluminum and copper, depending on whether they are to be used for connecting the frictional engagement elements to the outer casing made from a ceramic material, or for connecting the elements to the inner casing made from a metallic or ceramic material.

If the points of adhesion to the inner wall of the outer casing are sufficiently strong and can withstand exposure to radioactivity, then according to the invention frictional engagement can be dispensed with. The outer wall of the inner casing and the contact element or elements used must then be designed so that sufficiently large adhering surfaces are provided corresponding to the desired thermal conditions of the system. If, for example in the embodiments according to FIGS. 26 to 31, the tongues 73, 74*a* or 75*a* can be stuck firmly enough to the inner wall of the outer casing, then the normal force applied by these tongues to the inner wall can be very slight or even nil. In the case of the tongues 73, when the two ends of the tongues are securely fixed to the outer casing and to the inner casing, the tongues will distort intermediate their ends under thermal stress.

Also, in the embodiments according to FIGS. 24 and 25, under certain circumstances frictional engagement that is a greater normal force, can be abandoned if the adhesive strength is sufficient. Other configurations for contact elements for adhesion only can also be considered. However, the possibility of frictional engagement assisted by adhesion is particularly attractive.

For an example of direct adhesive contact solely between the outer wall of the inner casing and the inner wall of the outer casing, a configuration comparable to that shown in FIG. 23 should be referred to. If the inner casing 65 in the areas between the corrugations 66 bears against the inner wall of the outer casing 67 and is adhered to it adequately, and no contact elements are provided in the corrugations, then a good heat transfer to the outer casing will be guaranteed, and the expansion of the inner casin which is to be expected under thermal stress can be absorbed by distortion in the area of the corrugations.

We claim:

1. A container for the storage of radioactive material comprising:

an inner casing for receiving the radioactive material;

at least one resiliently deformable contact element formed of heat conducting material, said contact element being coupled to the inner casing; and an outer casing made of ceramic material and having a smooth inner wall, the inner casing being held within the outer casing solely by the contact element which is resiliently biased by deformation into friction contact with the inner wall of the outer casing, the contact between said contact element and inner wall being distributed over a large surface area of the inner wall.

2. A container according to claim 1, wherein the contact element is a frictional engagement element comprising a slotted sleeve (12) and an abutment (13) which is coupled to the inner casing, the slot in said sleeve providing compressibility to the sleeve responsive to circumferential compressive loading.

3. A container according to claim 2 wherein the slotted sleeve comprises at least two slotted sleeves (25, 26) fitting inside each other, the slots of which are circumferentially staggered.

4. A container according to claim 2 or 3 wherein the abutment extends over an end surface of the inner casing.

5. A container according to claim 2 or 3 wherein the sleeve is formed integrally with the abutments (FIGS. 3, 4).

6. A container according to claim 1 wherein said contact element is frictionally coupled to the inner casing.

7. A container according to claim 1 wherein said contact element is coupled to the inner casing in a form-locking manner.

8. A container according to claim 6 wherein said contact element is coupled to the inner casing in a frictional and form-locking manner.

9. A container according to claim 1 wherein said contact element is adhesively attached to the inner wall of the outer casing.

10. A container according to claim 1 wherein a deformable contact element is provided at each end of the inner casing.

11. A container according to claim 1 wherein in the area of the frictional contact, the inner wall of the outer casing and the surface of the contact element contacting the inner wall of the outer casing are formed in the shape of truncated cones having corresponding angles.

12. A container according to claim 10 wherein the inner wall of the outer casing comprises two friction engagement contact areas in the shape of truncated cones with the larger cross sections of the truncated cone shaped contact areas adjacent to the ends of the casing and wherein the surfaces of the contact elements contacting the inner wall of the outer casing are formed in the shape of truncated cones having corresponding angles.

13. A container according to claim 2 wherein means (25*d*, 26*d*; 33) are provided to limit the compressibility normal to the slot of the slotted sleeve (FIGS. 6; 8).

14. A container according to claim 2 wherein the abutment is a slotted ring (36) held by at least one intermediate ring (38) (FIG. 9).

15. A container according to claim 2 wherein the abutment is a slotted ring (38) loosely held by means of bolts (36) on the sleeve (FIG. 11).

16. A container according to claim 2 wherein the abutment is an abutment ring (43) loosely threaded on the free end of the sleeve (FIG. 13).

17. A container according to claim 2 wherein the abutment is an abutment ring (47) which can be locked in a form locking manner on one end of the sleeve (48) by means of slidable locking elements (49) (FIG. 15).

18. A container according to claim 2 wherein the slot is one of a straight-line elongate slot, a wavy slot extending generally in a longitudinal direction, and a helical slot.

19. A container according to claim 2 wherein a support (14) for the inner casing on the abutment is formed so as to be a flexible spring element between the abutment and the inner casing.

20. A container according to claim 1 or 6 wherein the inner casing is held by several contact elements (71, 72, 73, 74, 75) with an essentially uniform distribution of the contact elements over a large surface area of the inner wall of the outer casing.

21. A container according to claim 20 wherein the contact elements (71, 72) are formed individually and are individually coupled to the inner casing (FIGS. 24, 25).

22. A container according to claim 20 wherein the contact elements (73, 74, 75) are formed, at least in groups, integrally with each other (FIGS. 26, 28, 30).

23. A container according to claim 20 wherein the contact elements (73, 74, 75) form tongues (73*a*, 74*a*, 75*a*) which lies under stress with their free ends bearing against the inner wall of the outer casing, and supported by their bases on the inner casing.

24. A container according to claim 23 wherein the tonues of the contact elements are punched out of a sleeve and are deformed outwardly, and the sleeve is coupled to the inner casing.

25. A container according to claim 9 wherein said contact element is adhesively attached to the inner wall of the outer casing by a ceramic adhesive.

* * * * *

UNITED STATES PATENT AND TRADEMARK OFFICE

CERTIFICATE OF CORRECTION

PATENT NO. : 4,488,048

DATED : December 11, 1984

INVENTOR(S) : Heinz Bienek, Wolfgang von Heesen, Wilhelm Wick

It is certified that error appears in the above-identified patent and that said Letters Patent is hereby corrected as shown below: On the title page;

Inventors: Add: Rudolf Finkbeiner, Ratingen, Fed. Rep. of Germany

Column 3, Line 36, delete "on" and substitute therefor---one---;

Column 5, Line 27, delete "base 4" and substitute therefor---base 3---;

Column 6, Line 24, delete "arrange" and substitute therefor---arranged---;

Column 7, Line 48, delete "coneshaped" and substitute therefor---cone-shaped---;

Column 7, Line 58, delete "5" and substitute therefor---25---;

Column 7, Line 60, before "adhesive bonding" insert---by---;

Column 8, Line 47, delete "cone shape" and substitute therefor---cone-shape---;

UNITED STATES PATENT AND TRADEMARK OFFICE

CERTIFICATE OF CORRECTION

PATENT NO. : 4,488,048

DATED : December 11, 1984

INVENTOR(S) : Heinz Bienek, Wolfgang von Heesen, Wilhelm Wick

It is certified that error appears in the above-identified patent and that said Letters Patent is hereby corrected as shown below:

| | |
|---|---|
| Column 8, Line 50, | delete "36C" and substitute therefor---36b and 36c---; |
| Column 9, Line 9, | delete "cover like" and substitute therefor---cover-like---; |
| Column 10, Line 48, | delete "engagment" and substitute therefor---engagement---; |
| Column 13, Line 5, | delete "casin" and substitute therefor---casing---; |
| Column 14, Line 2, Claim 24. | delete "tonues" and substitute therefor---tongues---. |

Signed and Sealed this

*Thirtieth* Day of *July 1985*

[SEAL]

*Attest:*

DONALD J. QUIGG

*Attesting Officer* *Acting Commissioner of Patents and Trademarks*